United States Patent [19]

Endo

[11] Patent Number: 4,554,904

[45] Date of Patent: Nov. 26, 1985

[54] TRIGGER ASSEMBLY FOR RUBBER BAND GUN

[76] Inventor: Mitsuo Endo, 1120 S. State, Clearfield, Utah 84015

[21] Appl. No.: 692,070

[22] Filed: Jan. 15, 1985

[51] Int. Cl.[4] ..... F41B 7/02; F41B 7/08

[52] U.S. Cl. ..... 124/18; 124/35 R

[58] Field of Search ..... 124/18, 19, 35 R, 37, 124/45, 27

[56] References Cited

U.S. PATENT DOCUMENTS

| | | | |
|---|---|---|---|
| 212,826 | 3/1879 | Weaver | 124/27 |
| 1,024,374 | 4/1912 | Stambaugh | 124/35 R UX |
| 1,234,163 | 7/1917 | Henderson | 124/35 R UX |
| 2,594,527 | 4/1952 | Wechsler | 124/37 X |
| 3,536,055 | 10/1970 | Endo | 124/18 |
| 4,033,313 | 7/1977 | Ryan | 124/35 R X |

FOREIGN PATENT DOCUMENTS

| | | | |
|---|---|---|---|
| 877421 | 8/1971 | Canada | 124/27 |
| 819013 | 8/1959 | United Kingdom | 124/27 |

*Primary Examiner*—Paul E. Shapiro

*Attorney, Agent, or Firm*—Harvey B. Jacobson

[57] ABSTRACT

A toy rubber band gun having a gun body defining an imitation barrel, a stock at the back of the barrel, and a handle depending from the stock. A trigger element in the form of a resilient wire has a forward end pivotally mounted on a pin in the stock, a trigger portion extending out through a slot on the bottom of the stock, an elongate portion extending from the trigger portion upwardly through the handle, and a loop portion extending from the elongate portion upwardly behind the handle, the loop portion terminating in a hooked tip biased against the back of the stock to form a retainer for a rubber band stretched along the length of the stock and barrel so that pulling back on the trigger portion draws the hooked tip away from the stock and releases the band. The trigger element is characteristically bent to enable its tension to be adjusted.

10 Claims, 4 Drawing Figures

TRIGGER ASSEMBLY FOR RUBBER BAND GUN

BACKGROUND OF THE INVENTION

This invention relates generally to rubber band-propelling toy guns and is a modification of the gun described in prior U.S. Pat. No. 3,536,055, the content of which is incorporated herein by reference.

Rubber band guns are generally well known. Typically, in such guns, a rubber band is stretched and retained lengthwise along the barrel of the gun and a trigger mechanism is provided for releasing the rearward end of the stretched rubber band, so that the band is projected from the muzzle end of the barrel. The gun described in the above-noted prior U.S. patent is formed generally in the shape of a pistol or revolver having an imitation barrel extending from the forward end of a stock, and a pistol grip depending from the stock. A trigger in the form of a suitably bent elongate resilient member, such as a wire, has a forward end embedded in the stock, a trigger portion extending from the forward end below the stock, an elongate portion extending rearwardly from the trigger portion along a passage formed through the top of the pistol grip, and a looped portion extending upwardly from the elongate portion behind the pistol grip and terminating in a hook-shaped tip engaging in a retention socket at the back of the stock. In operation, rubber bands may be stored on the looped portion of the trigger in back of the gun. When it is desired to fire the gun, one band is pulled up from the looped portion of the trigger, stretched along the length of the gun, and its forward end is pulled over the front of the barrel so that the band is retained in stretched condition lengthwise on the gun with its forward end over the front end of the barrel and its rearward end engaged and retained on the hook-shaped tip of the trigger. Then, rearward pressure on the trigger portion of the trigger draws the hook-shaped tip out from the retention socket in the stock of the gun thereby releasing the band which is projected from the front of the gun. The trigger is biased forwardly, so that when released it returns the hook-shaped tip back into engagement in the retention socket ready to receive the next band. Bands are also loaded onto the looped portion of the trigger by disengaging the tip from the socket as aforesaid.

The present invention is directed toward the provision of a rubber band gun of the same general character and mode of operation as the gun described in the above U.S. patent, but having certain improvements or modifications, particularly in relation to the trigger mechanism.

STATEMENT OF PRIOR ART

Additional to the patent discussed above, applicant is aware of the following U.S. patents pertaining to rubber band guns and the like. None of these, however, discloses a gun having the features of the present invention.

U.S. Pat. Nos. 808,621, F. M. Ball, Jan. 2, 1908.
1,839,700, P. T. Pino, Jan. 5, 1932.
1,868,312, W. A. Coventry, July 19, 1932.
3,745,986, R. E. Crowson, July 17, 1973.
4,033,313, J. Ryan, July 5, 1977.
4,436,077, W. G. Smith, Mar. 13, 1984.

SUMMARY OF THE INVENTION

A rubber band gun in accordance with the present invention is of generally similar character to the gun described in U.S. Pat. No. 3,536,055 insofar as it has a trigger in the form of a suitably bent elongate resilient element, such as a length of wire, having a forward end mounted in the stock of the gun, a trigger portion extending downwardly from the forward end, an elongate portion extending rearwardly from the trigger portion through the handle of the gun, and a looped portion extending rearwardly and upwardly from the elongate portion behind the handle, the looped portion terminating in a hooked tip for engagement against the back of the gun stock. In accordance with the present invention, however, the forward end of the trigger, rather than being embedded in the stock of the gun as in the prior patent, is pivotally mounted, for example on a pin in the stock which engages an eye formed on the end of the trigger, the forward end of the trigger being provided with a degree of pivotal movement in the stock, and the elongate portion of the trigger also being provided with a degree of up and down movement where it enters the handle. Further, the trigger may be provided with a characteristic series of bends which may be manipulated so as to adjust the tension of the trigger making it more or less difficult to pull, and providing a means for increasing the trigger tension should, for example, the trigger become slack with prolonged use of the gun. Mounting of the forward end of the trigger on a pin in the stock of the gun enhances retention of the trigger in the gun, and the design lends itself to manufacture of the gun in the form of left and right plastic moldings which fit together with the trigger trapped therebetween.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
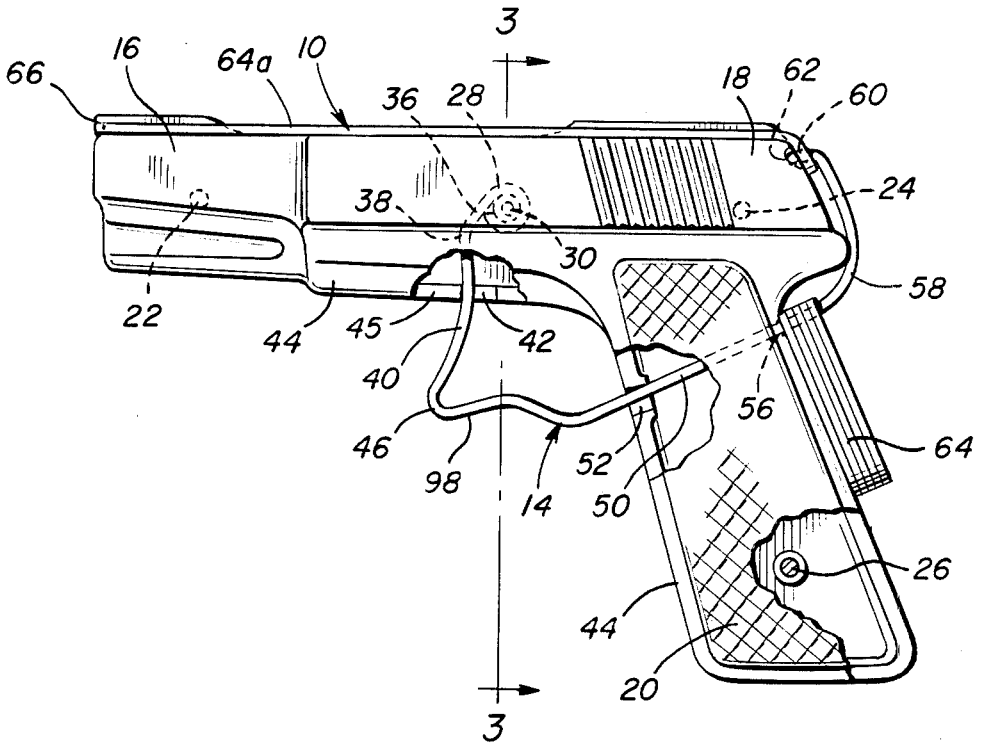
FIG. 1 is a side elevational view, part broken away, of a rubber band gun in accordance with the invention.
Figure 2:
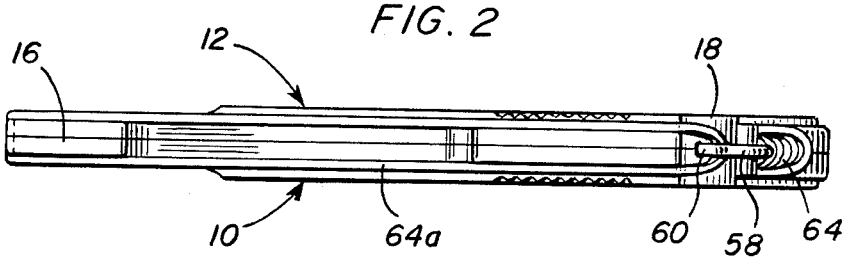
FIG. 2 is a plan view of the gun.
Figure 3:
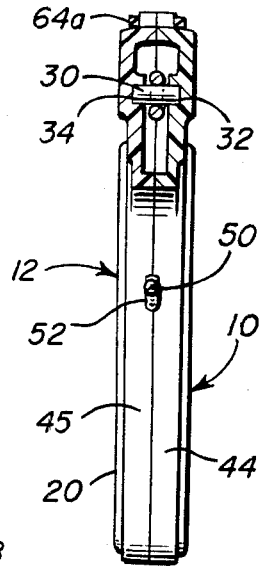
FIG. 3 is a sectional view on line 3—3 of FIG. 1.

The illustrated toy rubber band gun is generally in the form of a pistol or revolver, comprising left and right shallow dish-like plastic moldings 10 and 12, and a trigger element in the form of a resilient elongate wire 14, trapped between the moldings. When assembled, the moldings define a gun body having an imitation barrel 16, a stock 18, and a handle or grip 20 depending from the stock. The moldings may be clamped together by any convenient means known in the art such as snap-together male and female fittings 22, 24, 26.

Trigger 14 has a forward end formed as an eye 28 which is pivotally mounted in the stock of the gun on a pin 30 which may be a separate plastic or metal pin fitting in sockets 32, 34 in the respective moldings 10, 12 or which may be integrally formed with one of the moldings. The trigger element has a short length 36 extending forwardly and downwardly from eye 28, a first bend 38, a concave length 40 extending through a slot 42 defined by grooves in rim portions 44, 45 of the respective moldings 10, 12, a second sharp bend 46, a concave length 48, a substantially straight length 50 extending into the front of handle 20 of the gun through a slot 52 defined by grooves in the molding rim portions and out of the back of the handle through opening 56, also defined by grooves in the respective rim portions, and an upwardly curved length 58 terminating in a hooked tip 60 which fits in a receiving socket 62 formed in the back of the stock.

Length 40 of the trigger element forms a trigger portion against which backward pressure is exerted when the gun is fired, and length 58 forms a looped storage portion for rubber bands 64 as in the prior patent. The slot 42 is of sufficient length to allow a degree of pivotal movement of the trigger about pin 30, and slot 52 in the front of the handle is likewise of a length to accommodate such movement. The opening 56, through which the trigger element extends at the back of the handle, however, is a substantially close fit around the trigger element to form a bearing in which length 50 of the trigger slides.

The characteristic shape of the resilient trigger element along with the positioning of the slots and openings in which it is received in the rim portions of the moldings 10 and 12 related to the position of pivot pin 30, and with elongate portion 50 extending up through the handle from slot 52 to the opening 56 at the back of the handle, provide a force resiliently biasing the trigger element to the position shown in FIG. 1 wherein tip 60 fits in the receiving socket 62, length 50 of the trigger element engages the upper wall of slot 52 and length 40 engages the forward wall of slot 42. In this condition of the gun, a leading band 64*a* from the looped portion 58 of the trigger element can be pulled up and stretched along the length of the gun so that its forward end loops over a notch 66 in the muzzle end of the barrel 16 while its rearward end is retained by tip 60 of the trigger element.

Figure 4:
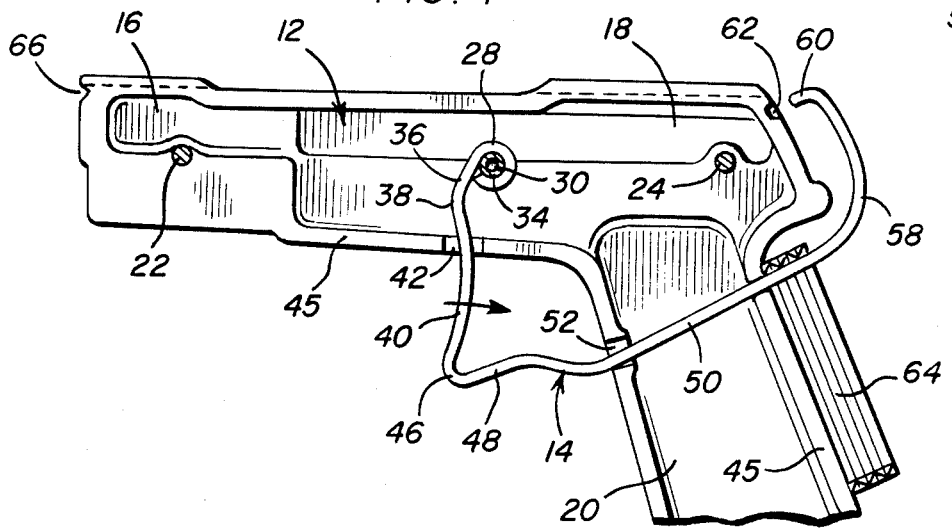
FIG. 4 is a sectional side elevational view of the gun showing operation of the trigger.

To fire band 64*a*, length 40 of the trigger element is pressed back against the tension of the trigger element (FIG. 4) providing a degree of pivoting of the forward end of the trigger about pin 30, movement of length 40 toward the rear wall of slot 42 equivalent downward movement of the forward end of length 50 in slot 52 and rearward lengthwise movement of length 50 in the opening 56 in the back of the handle, so as to withdraw tip 60 of the trigger element from socket 62 and release the stretched rubber band. This movement of the trigger element is also used for loading rubber bands onto loop 58. When the trigger element is released, the biasing force thereon returns the trigger element to the position shown in FIG. 1.

The characteristic bent shape of the trigger element allows the trigger tension to be varied by tightening or relaxing the bends therein, particularly bend 46, which is useful should, for example, the tension of the trigger become slack due to continued use. Further, the pin and eyetype mounting of the forward end of the trigger in the gun provides a secure attachment and the gun can be readily manufactured from economically molded components.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A toy rubber band gun having an imitation barrel extending from a stock, a handle depending from the stock, and an elongate resilient trigger element having a forward end secured in the stock, a trigger portion extending downwardly through the stock from said forward end, an elongate portion extending rearwardly from the trigger portion through retention means in the handle of the gun and a looped portion extending upwardly from the elongate portion behind the handle, the looped portion terminating in a hooked tip for engaging receiving means at the back of the stock to form a retainer means for a rubber band stretched lengthwise along the gun, the positioning of the retention means related to the position of the forward end of the trigger element providing a biasing force on the trigger element urging the tip portion forwardly into engagement with the receiving means for rearward withdrawal therefrom by the application of a rearward force on said trigger portion of the trigger element, wherein the gun includes means pivotally mounting the forward end of the trigger element in the stock, the trigger portion of the trigger element extending from the stock through first slot means for accommodating a degree of pivotal movement of the trigger portion during forward and reverse movement thereof, and the elongate portion of the trigger element extending into the handle through further slot means also accommodating said pivotal movement.

2. The invention of claim 1 wherein the trigger element includes a first length extending from the forward end thereof downwardly and forwardly to a first bend in the trigger element, a second concave length defining the trigger portion extending downwardly through the first slot means to a second sharp bend in the trigger element, and a third concave length extending rearwardly from said sharp bend to join with said elongate portion of the trigger element.

3. The invention of claim 1 wherein the means pivotally mounting the trigger element comprises a pin in the stock of the gun inserted through an eye formed in a front end of the trigger element.

4. The invention of claim 3 wherein the gun includes a gun body defining the barrel, stock and handle, said body comprising interfitting left and right shallow dish-like members with surrounding rim portions, and means attaching the members together rim portion to rim portion with the trigger element trapped therebetween, the respective slot means comprising slots in the rim portions and the retention means including grooves in the respective rim portions at the back of the handle forming a slide bearing to accommodate lengthwise movement of the elongate portion of the trigger element.

5. The invention of claim 4 wherein said members are plastic moldings.

6. An elongate resilient trigger element for a rubber band gun having a pivot eye formed at one end thereof, the element having a first length extending from the pivot eye to a first bend in the element, a second concave length defining a trigger portion extending from said first bend to a second sharp bend, a third concave length extending from said sharp bend to a third bend, an elongate length extending from said third bend, and a loop portion extending from said elongate length, the loop portion terminating in a hooked tip at the other end of the element.

7. The invention of claim 6 wherein the element is made of wire.

8. A toy rubber band gun comprising a gun body defining an imitation barrel, a stock at the back of the barrel, and a handle depending from the stock, the gun further including a trigger element of elongate resilient material having a forward end formed as an eye secured on a pin in the stock of the gun, a trigger portion extending downwardly through a slot in the bottom of the stock for accommodating back and forth movement of the trigger portion, an elongate portion extending rearwardly from the trigger portion through a further slot in the front of the handle for accommodating up and down movement of the elongate portion up through the handle and out through a slide bearing in back of the handle for accommodating lengthwise movement of the elongate portion, and a loop portion extending upwardly from the elongate portion behind the handle and terminating in a hooked tip biased into engagement against the back of the stock whereby rearward pressure on the trigger portion of the trigger element disengages the hooked tip from the back of the stock and release of said rearward pressure on the trigger portion reengages the hooked tip with the back of the stock.

9. The invention of claim 8 wherein the trigger element has a sharp bend at the bottom of the trigger portion for adjusting the tension of the trigger element by selectively tightening and relaxing the sharp bend, the sharp bend being connected to the elongate portion by a concave length of the trigger element.

10. The invention of claim 9 wherein the gun body is formed from left and right shallow dish-like members with surrounding rim portions, and means attaching the members together rim portion to rim portion with the trigger element trapped therebetween, said slots and said slide bearing being formed in the respective rim portions of said members.

* * * * *